US007422471B1

(12) United States Patent
Wu

(10) Patent No.: US 7,422,471 B1
(45) Date of Patent: Sep. 9, 2008

(54) ELECTRICAL CONNECTOR WITH HEAT SINK FUNCTION

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/893,073

(22) Filed: Aug. 14, 2007

(51) Int. Cl.
*H01R 13/58* (2006.01)

(52) U.S. Cl. ..... 439/485

(58) Field of Classification Search ..... 439/485, 439/487

See application file for complete search history.

(56) References Cited

U.S. PATENT DOCUMENTS 6,442,026 B2 * 8/2002 Yamaoka ..... 361/704
6,881,077 B2 * 4/2005 Throum ..... 439/76.1
7,112,086 B1 9/2006 Wu
7,232,332 B2 * 6/2007 Osborn et al. ..... 439/487
7,244,141 B2 * 7/2007 Yamane et al. ..... 439/485
2002/0141159 A1 * 10/2002 Bloemen ..... 361/704
2003/0171026 A1 * 9/2003 Dorrhofer et al. ..... 439/485

* cited by examiner

*Primary Examiner*—Gary F. Paumen
(74) *Attorney, Agent, or Firm*—Wei Te Chung

(57) ABSTRACT

An electrical connector adapted for mating with a mating connector, includes a base member, a cover member, and a terminal holder. The base member has a base frame, a mating frame formed at a front end of the base frame, and an engaging opening defined in upper walls of the base frame and the mating frame. The cover member has a rib at a front end thereof. The terminal holder is assembled between the base member and the cover member and comprising an insulative housing, a printed circuit board assembled onto the housing, an IC module assembled onto the housing, a plurality of terminals received in the housing and a tongue board extending forwardly from the housing into the mating frame. The cover member also has a heat sink member to touch with the IC module to conduct heat from the IC module to the heat sink member.

20 Claims, 8 Drawing Sheets

ELECTRICAL CONNECTOR WITH HEAT SINK FUNCTION

BACKGROUND OF THE INVENTION

1. Field of the Invention

The present invention generally relates to an electrical connector, and more particularly to an electrical connector with heat sink function.

2. Description of Prior Art

With the development of communication and computer technology, high density electrical connectors with conductive elements in a matrix arrangement are desired to construct a large number of signal transmitting paths between two electronic devices. Such high density electrical connectors are widely used in internal connecting systems of servers, routers and the like devices requiring high speed data processing and communication.

One interface of the high density electrical connectors known in the art is infiniband, for example, as shown in U.S. Pat. No. 7,112,086. Such an infiniband connector comprises a base member, a cover, a connector module having a plurality of terminals thereon, and an interface locating at an end of the base member. The connector module is enclosed in a room which is formed by the base member and the cover. The interface comprises a metallic shielding shroud encircling a plurality of conductive terminals therein for shielding electrical termination from external electromagnetic interference. The configuration of the shielding shroud is defined by upper and lower elongated shielding walls extending forwardly from the connector, and two oppositely angled end walls which form a substantially trapezoidal shape. The trapezoidal shape provides a polarizing feature for preventing mismating. For the development of the connector, more and more connectors need an IC module build in the connector. However, the IC module will produce heat in working process, and the heat is difficult to sink because the connector module is covered by the cover and the base member and the cover doesn't directly touch to the connector module.

Hence, an electrical connector having a die cast cover with heat sink function is desired to overcome the disadvantages of the prior art.

BRIEF SUMMARY OF THE INVENTION

Accordingly, the object of the present invention is to provide an electrical connector having a cover member with heat sink function.

In order to achieve the above-mentioned object, an electrical connector adapted for mating with a mating connector in accordance with the present invention comprise a base member, a cover member, and a terminal holder. The base member has a base frame and a mating frame formed at a front end of the base frame. The cover member is assembled with the base member to define a space therebetween having a top surface and a bottom surface. The terminal holder is received in the space formed between the base member and the cover member and comprising an insulative housing and a printed circuit board assembled onto the housing to electrically connect to a plurality of terminals. An IC module is assembled onto the base member. The plurality of terminals and a tongue board extend forwardly from the housing into the mating frame. The cover member also has a heat sink member extending downwardly from the bottom surface to touch with the IC module to conduct heat from the IC module to the heat sink member.

Other objects, advantages and novel features of the invention will become more apparent from the following detailed description of the present embodiment when taken in conjunction with the accompanying drawings.

DETAILED DESCRIPTION OF THE INVENTION

Figure 1:
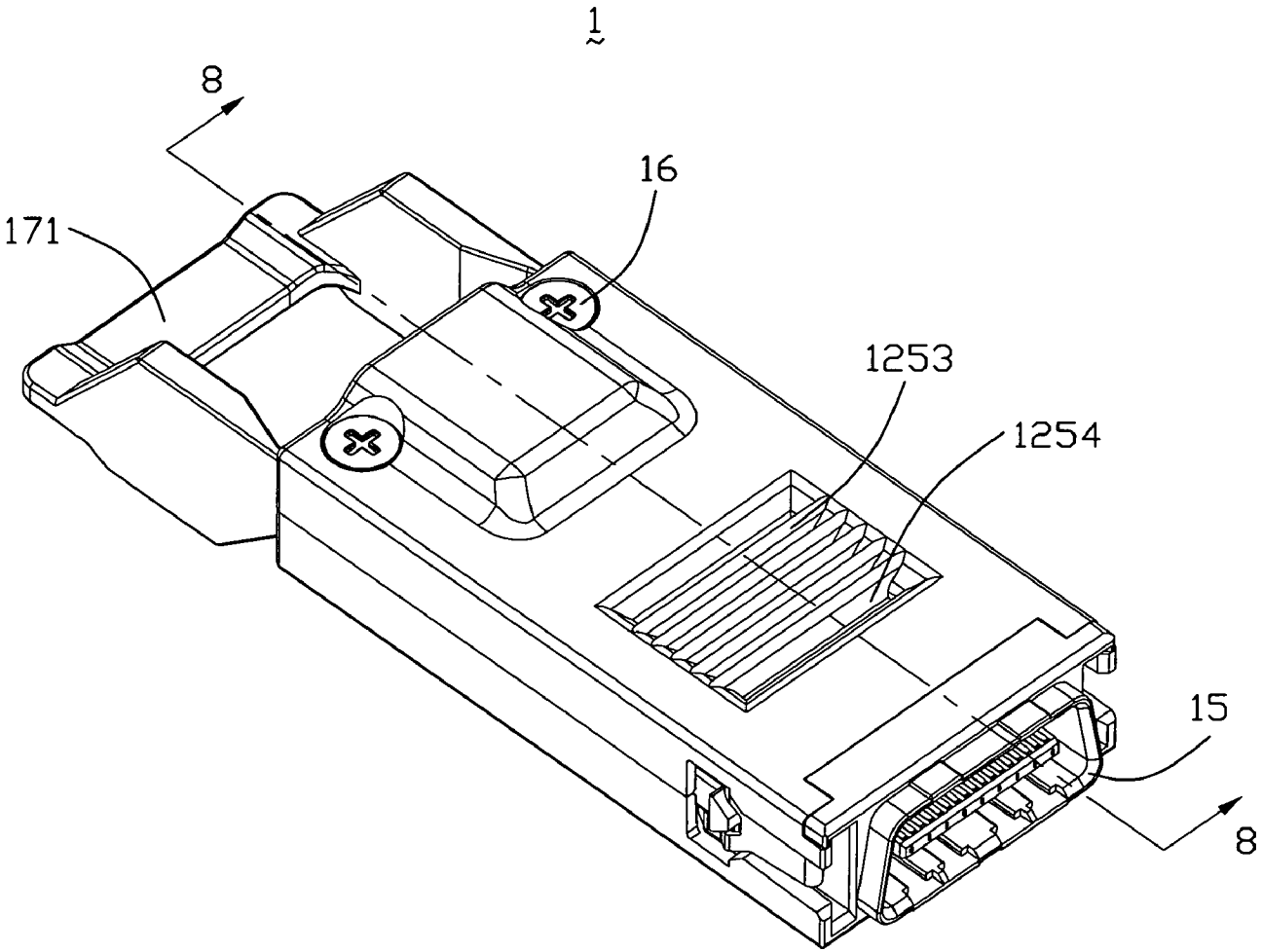
FIG. 1 is an assembled, perspective view of an electrical connector in accordance with the present invention.
Figure 2:
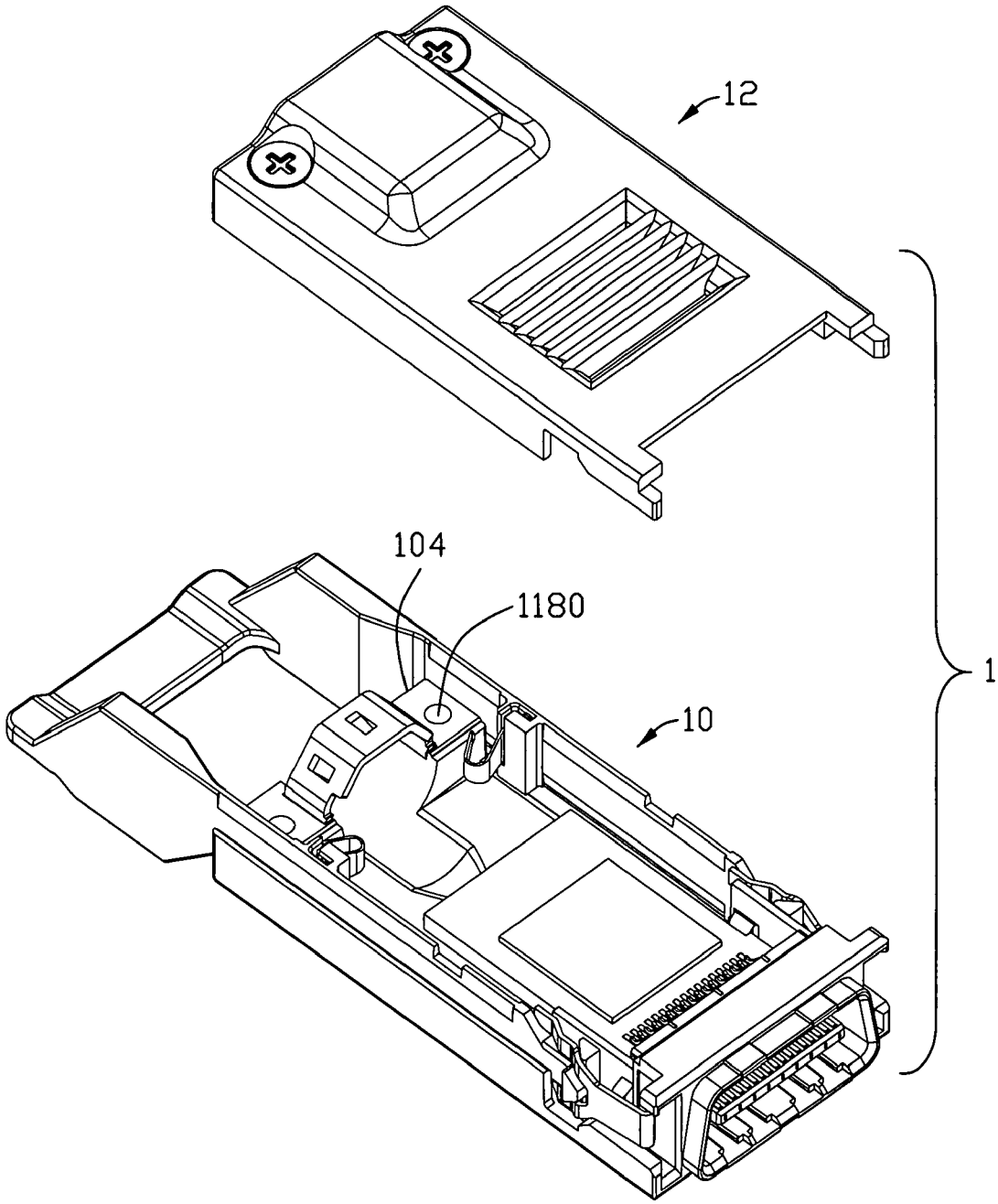
FIG. 2 is a partly exploded, perspective view of an electrical connector in accordance with the present invention.

Reference will now be made to the drawing figures to describe the present invention in detail.

Figure 3:
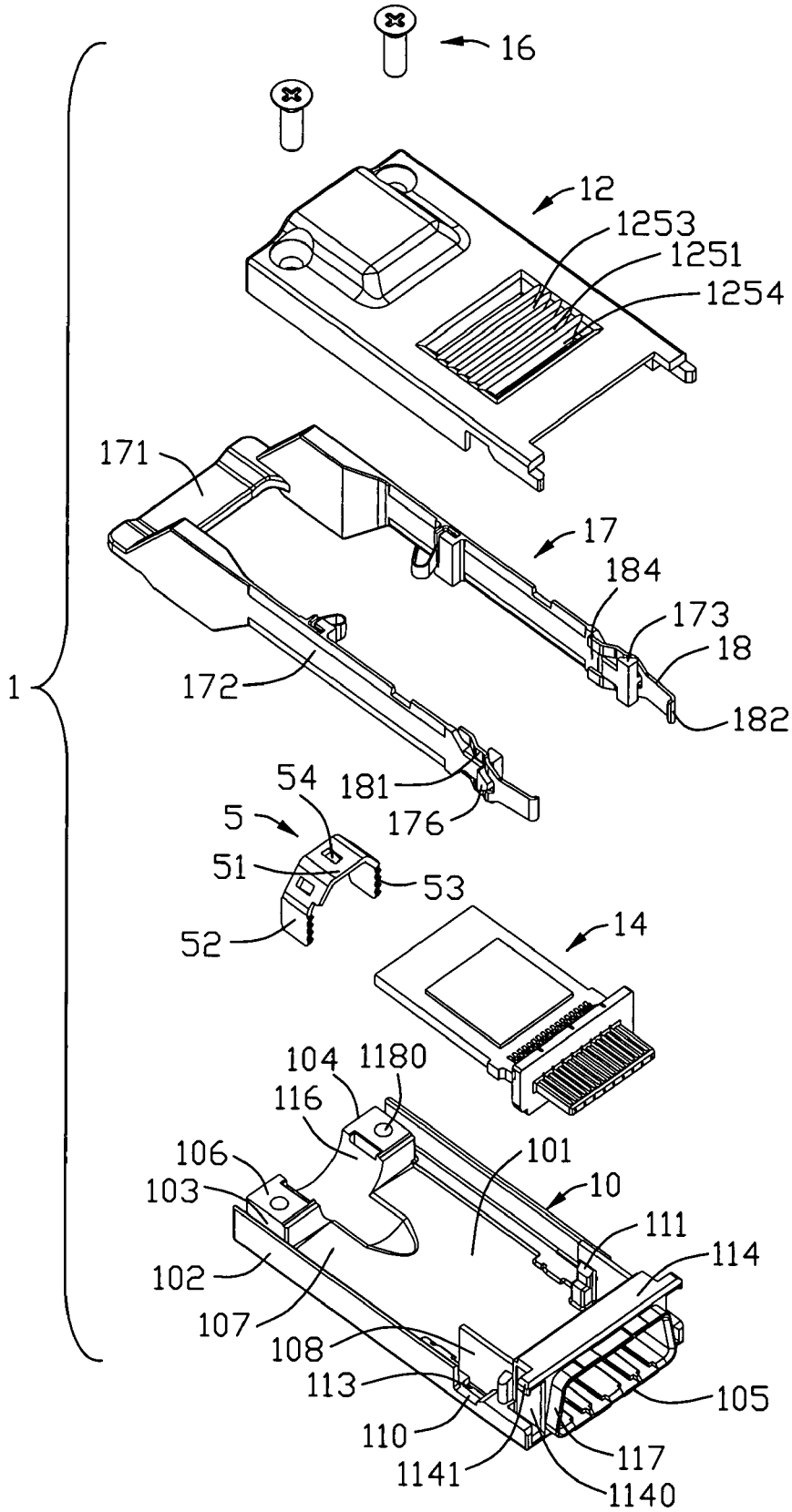
FIG. 3 is an exploded, perspective view of an electrical connector in accordance with the present invention.

Referring to FIGS. 1-5, an electrical connector 1 of the present invention comprises a base member 10, a cover member 12 assembled on the base member 10, a terminal holder 14 received in a space defined between the base member 10 and the cover member 12, a pair of screws 16 to fasten the cover 12 with the base member 10, a pull tab 17 and a pair of latch springs 18 capable of being actuated by the pull tab 17 to separate the electrical connector 1 from a complementary connector. As best shown in FIG. 3, both the base member 10 and the cover member 12 are formed by die casting metallic material, e.g., aluminum alloy. The base member 10 has a receiving space 107 defined by a base plate 101 and a pair of sidewalls 102 which upwardly extend from opposite lateral sides of the base plate 101. Each sidewall 102 defines an elongated channel 103 from a rear end 104 toward a front end 105 and extending through a top engaging face 106 of the base member 10. Each sidewall 102 comprises a shoulder portion 108 and a cutout 110 formed adjacent to the front end 105 at opposite lateral sides of the channel 103. A pair of blocks 111 is further formed on inner sides of the shoulder portions 108 and each block 111 defines thereon a stepped mounting edge for receiving the terminal holder 14, which will be described in greater detail hereinafter.

Figure 5:
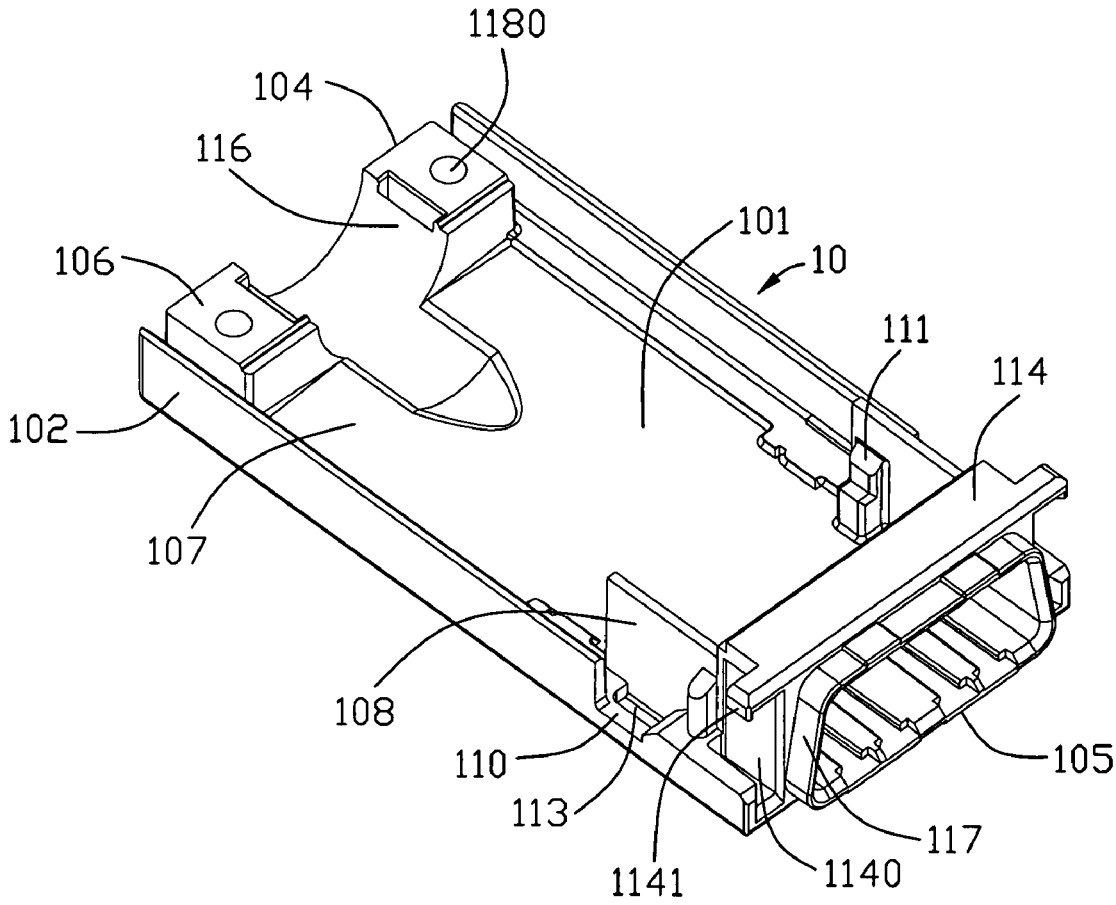
FIG. 5 is an enlarged, perspective view of a base member shown in FIG. 3.

Referring to FIG. 5, the base plate 101 of the base member 10 defines a pair of depressions 113 located between the shoulder portions 108 and corresponding cutouts 110. The base member 10 also forms a base frame 114 and a mating frame 117 extending forwardly from the base frame 114 at the front end 105. The mating frame 117 is integrally formed with the base frame 114 and is thinner than the base frame 114. The base frame 114 is formed with a pair of engaging ears 1141 extending laterally from opposite top sides thereof and a pair of engaging channels 1140 in opposite outer sides thereof. At the rear end 104 of the base member 10, a substantially semicircular first opening 116 is provided for the extension of a cable (not shown).

A strain relief member 5 is assembled to the cable. The strain relief member 5 is typically made of electrical conductive material with high rigidity, such as copper. The strain relief member 5 has an arcuate portion 51 and a pair of legs 52 extending downwardly from bottom ends of the arcuate portion 51. Each leg 52 has a plurality of barbs 53 on front edge thereof. The arcuate portion 51 has a plurality of securing tabs 54 punched inwardly. A pair of screw holes 1180 defined on the top engaging face 106 are arranged at opposite sides of the opening 116, respectively.

Figure 4:
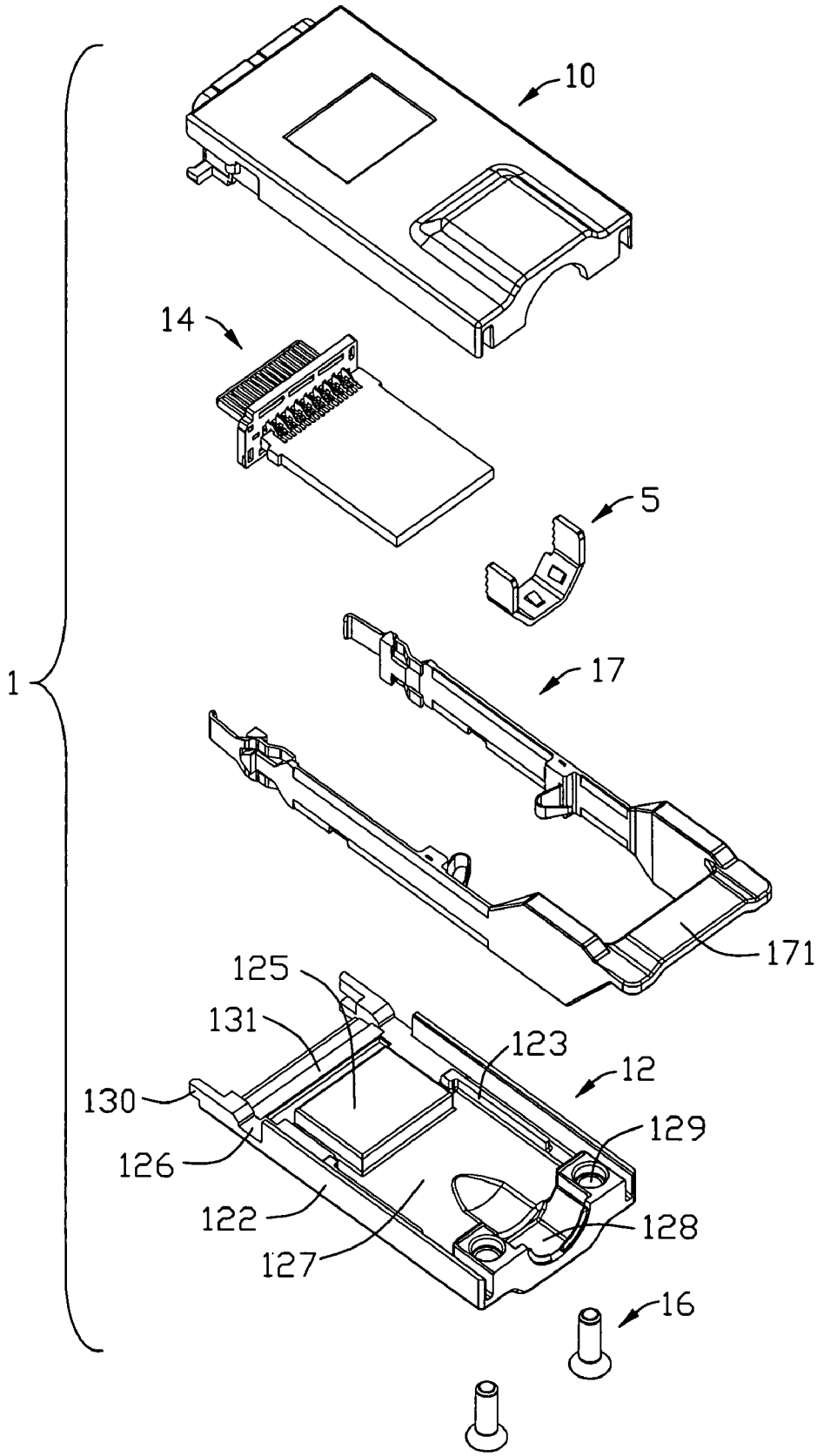
FIG. 4 is a view similar to FIG. 3, but viewed from another aspect.
Figure 6:
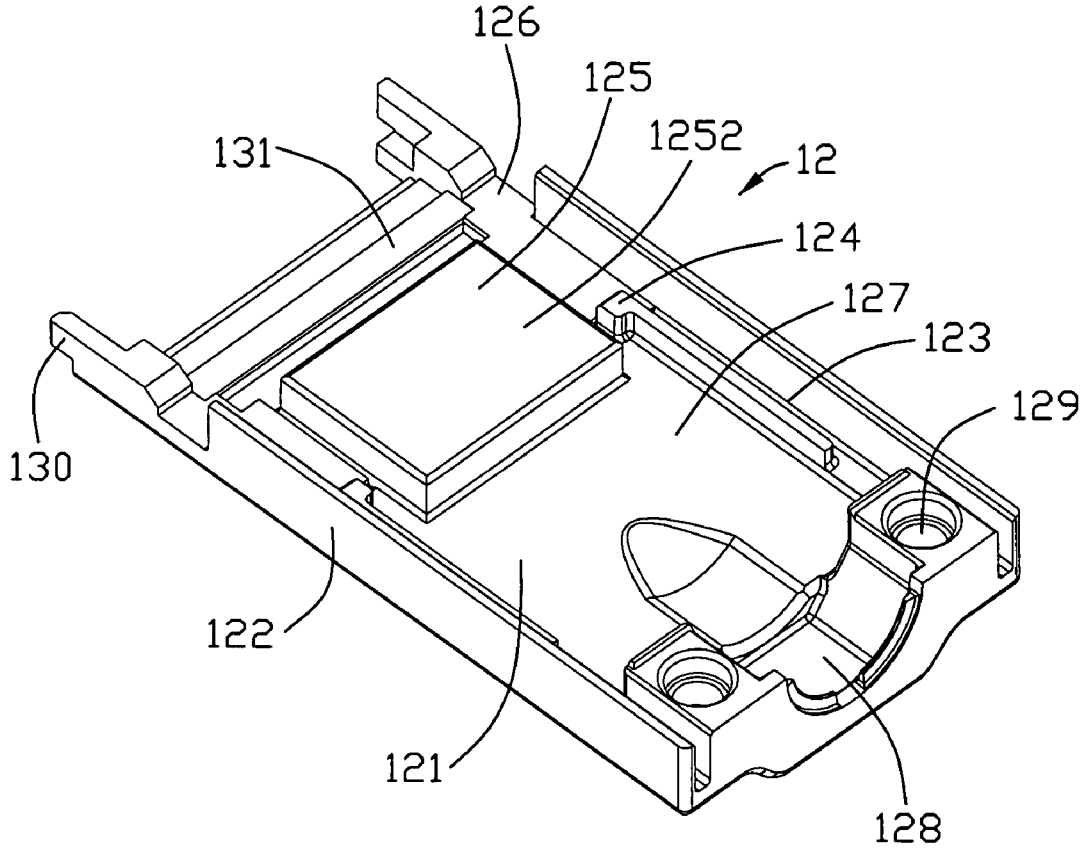
FIG. 6 is an enlarged, perspective view of a cover member shown in FIG. 3.

Particularly referring to FIGS. 3, 4, and 6, the cover member 12 defines a receiving space 127 surrounded by a cover plate 121 and a pair of sidewalls 122 extending downwardly from opposite lateral sides of the cover plate 121. Each sidewall 122 defines a channel 123 therealong corresponding to the channel 103 of the base member 10. A pair of projections 130 extends forwardly from opposite sides of a front end of the cover plate 121. A pair of lumps 124 extend downwardly from the cover plate 121 in correspondence with the blocks 111 of the base member 10 for cooperating with the blocks 111 to thereby secure a printed circuit board 142 (FIG. 7) of the terminal holder 14 in appropriate position. Similarly, a pair of cutouts 126 is defined in respective sidewalls 122 corresponding to the cutouts 110 defined in the base member 10. A rib 131 protrudes downwardly from a front end of the cover plate 121. A heat sink member 125 protrudes downwardly from the cover plate 121 and adjacent to the rib 131. The heat sink member 125 comprises a top surface 1251 and a bottom surface 1252. The top surface 1251 is slotted to form a plurality of ribs 1253 and a plurality of cuniform cutouts 1254. Each cuniform cutout 1254 locates at the middle of the two ribs 1253. The ribs 1253 of the heat sink member 125 have equal thickness along mating direction for uniformly emanating heat. The bottom surface 1252 as a touching surface conducts heat from IC module 145 to heat sink member 125. A substantially semicircular second opening 128 is provided in a rear end of the cover member 12 in correspondence with the first opening 116 of the base member 10. A pair of through-holes 129 is provided on opposite sides of the opening 128, each through-hole 129 having a diameter substantially equal to an outer diameter of each screw 16.

Turning to FIG. 3, the pull tab 17 and the pair of latch springs 18 are engaged with each other. Specifically, each of the latch springs 18 is formed by stamping a metal sheet, and has a body 181, and an L-shaped latching portion 182. An elongated cutout 184 is defined along the length of the body 181.

The pull tab 17 includes a transverse operable portion 171, a pair of parallel arms 172 extending forwardly from opposite sides of the operable portion 171, and a pair of latch releasing portions 173 formed at distal ends of the arms 172, respectively. Each latch releasing portion 173 has an embossment 176 protruding outwardly from an outer face thereof.

Figure 7:
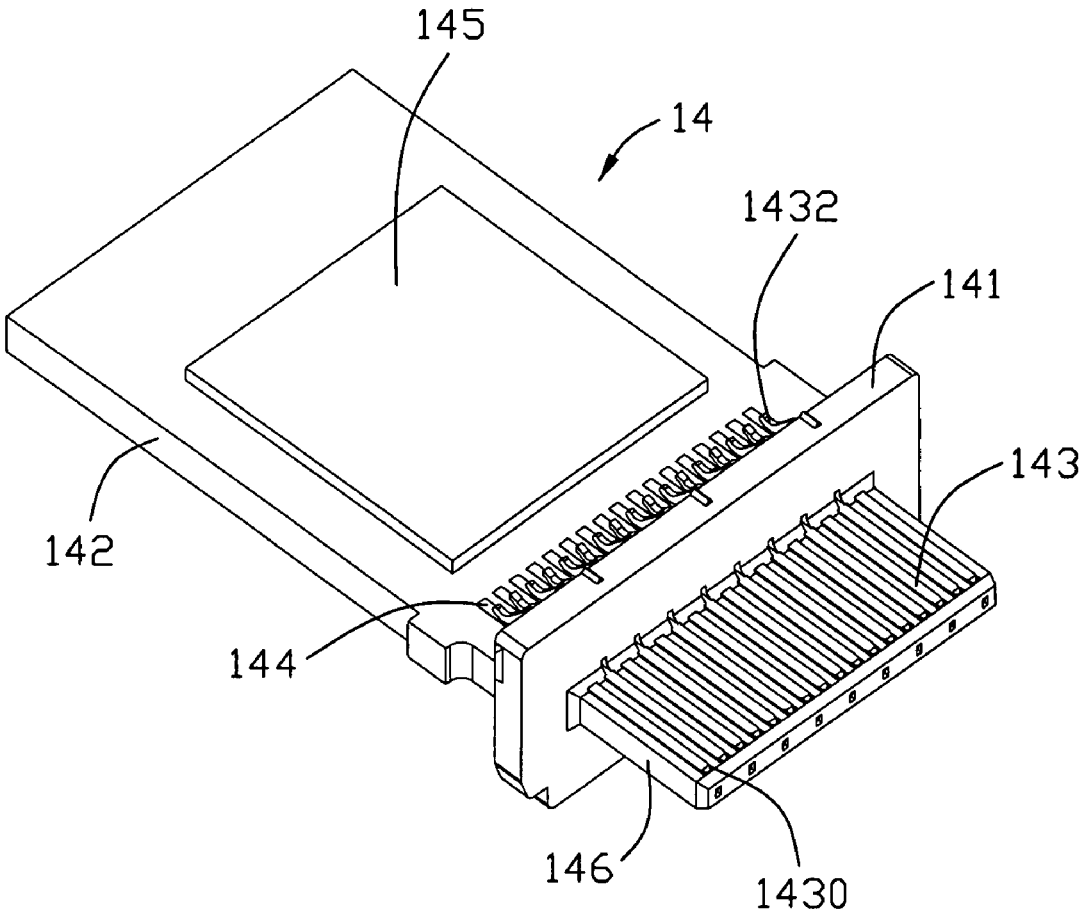
FIG. 7 is an enlarged, perspective view of a terminal holder shown in FIG. 3.

With reference to FIG. 7, the terminal holder 14 of the electrical connector 1 is shown in detail. The terminal holder 14 is assembled between the base member 10 and the cover member 12 and comprises an insulating housing 141, the printed circuit board 142 assembled onto a rear side of the housing 141, an IC module 145 arranged on top surface of the printed circuit board 142, and a plurality of conductive terminals 143 accommodated in the housing 141. The printed circuit board 142 has a number of first conductive pads 144 formed on a forward end of both sides thereof and two bulges (no tab) respectively formed on two sides of the printed circuit board 142. Soldering portions 1432 of the terminals 143 are electrically soldered with the first conductive pads 144 and contacting portions 1430 of the terminals 143 are disposed in a tongue board 146 formed at a front end of the housing 141 for electrically connecting with a complementary connector (not shown).

Turning back to FIG. 1 in conjunction with FIGS. 2-8, in assembly, the terminal holder 14 is assembled to the base member 10 with the tongue board 146 placed in the mating fame 117. The printed circuit board 142 is located in the receiving space 107 of the base member 10, supported by the blocks 111 and blocked by the two bulges engaging to the blocks 111. The two latch springs 18 are respectively assembled to the arms 172 of the pull tab 17 by extending the embossments 176 into the cutouts 184 from inner faces of the latch springs 18, whereby the latch releasing portions 173 engage with the inner faces of the latch springs 18, respectively. Then, the latch springs 18 together with the pull tab 17 are assembled to the base member 10. The arms 172 of the pull tab 17 are placed into the channels 103 of the base member 10 with the operable portion 171 located outside the rear end 104 of the base member 10. Lower ends of the latch releasing portions 173 are accommodated in corresponding depressions 113. The L-shaped, latching portions 182 are housed at opposite sides of the front end 105 of the base member 10 for latching with the complementary connector.

Figure 8:
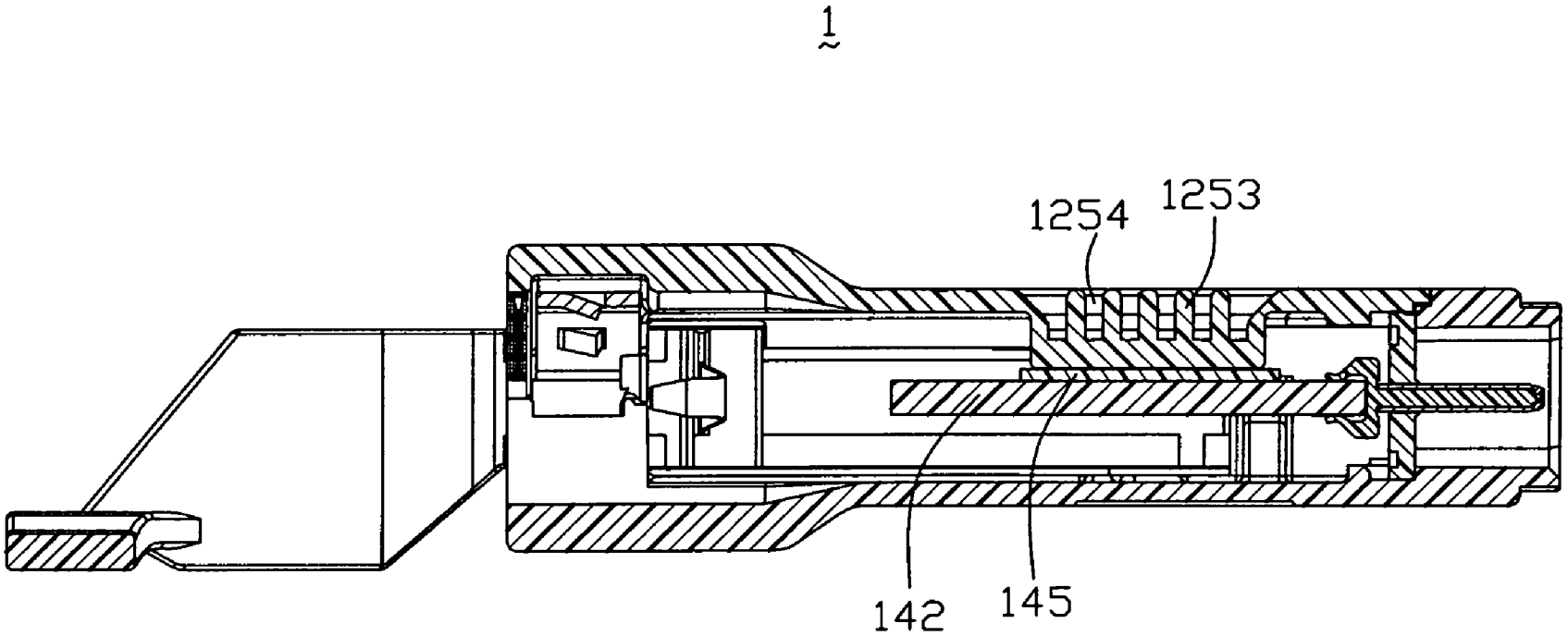
FIG. 8 is a cross-sectional view taken along line 8-8 of FIG. 1.

Referring to FIGS. 2-7 in conjunction with FIG. 8, the cover member 12 is attached onto the base member 10 by placing the projections 130 below the pair of engaging ears 1141. Then a rear portion of the cover member 12 is rotated downwardly about the pair of engaging ears 1141 until the bottom face of the cover member 12 intimately abuts the top engaging face 106 of the base member 10. In this manner, the mating frame 117 forms a D-shaped mating interface 15 with the tongue board 146 of the terminal holder 14 extending therein for accommodating insertion of a mating connector (not shown). The first and the second openings 116, 128 together form a cable exiting opening (not shown) for extension of the cable therethrough. Finally, the pair of screws 16 are put into the through holes 129 and screwed into the screw holes 1180 to securely fasten the cover member 12 and the base member 10 together, whereby the electrical connector 1 in accordance with the present invention is obtained. The area of the top surface of the IC module 145 is bigger than the bottom surface of the heat sink member 125. Since the heat sink member 125 touches the top surface of the IC module 145 to conduct heat from IC module 145 to heat sink member 125, and the heat sink member 125 emanates heat to the air. Further more, the heat sink member 125 comprises a plurality of ribs 1253 and a plurality of cuniform cutouts 1254 to achieve favourably heat sinking to the IC module 145.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector having a mating port adapted for mating with a mating connector, comprising:

a base member having a base frame;

a cover member assembled with the base member to define a space therebetween; and a printed circuit board is received in the space formed between the base member and the cover member; an IC module is assembled onto the printed circuit board; wherein One of the base member and the cover member also having a heat sink member extending downwardly there from and comprising a bottom surface touching with the IC module to conduct heat from the IC module to the heat sink member and a top surface forming a plurality of cutouts opening towards outside for distributing heat.

2. The electrical connector as described in claim 1, further comprising a terminal holder received in the space formed between the base member and the cover member and comprising an insulative housing and a printed circuit board assembled onto the housing to electrically connect to a plurality of terminals; the plurality of terminals and a tongue board extend forwardly from the housing into the mating frame.

3. The electrical connector as described in claim 1, wherein the cover member has a heat sink member extending downwardly there from and is integrally formed with the heat sink member.

4. The electrical connector as described in claim 1, wherein the top surface comprises a plurality of ribs and a plurality of cutouts for distributing heat; the cutouts recess downwardly from the top surface of the cover member.

5. The electrical connector as described in claim 4, wherein the cover member has a pair of projection at a front end thereof, each projection locates at the middle of the two cutouts along a direction perpendicular to the cover member.

6. The electrical connector as described in claim 1, wherein the heat sink member extends downwardly from an inner surface of the cover member.

7. The electrical connector as described in claim 1, wherein the ribs of the heat sink member have equal thickness.

8. The electrical connector as described in claim 1, wherein the mating interface has a trapezoidal configuration.

9. The electrical connector as described in claim 1, wherein the base member comprises a pair of engaging ears extending laterally from opposite top sides thereof, the cover member comprises a pair of projections extending forwardly from opposite lateral sides thereof, the projections being positioned below the corresponding engaging ears.

10. The electrical connector as described in claim 1, further comprising a pull tab assembled between the base member and the cover member, and a pair of latch springs assembled on the pull tab.

11. The electrical connector as described in claim 1, wherein the base member and the cover member are both die cast member.

12. The electrical connector as described in claim 10, wherein the pull tab comprising a transverse operable portion, a pair of parallel arms extending forwardly from opposite sides of the operable portion, and a pair of latch releasing portions formed at distal ends of the arms, respectively, each latch releasing portion has an embossment protruding outwardly from an outer face thereof.

13. The electrical connector as described in claim 12, wherein each of the latching springs are formed by stamping a metal sheet, and each has a body defining an elongated cutout, and an L-shaped latching portion.

14. The electrical connector as described in claim 13, wherein two latch spring are respectively assembled to the arms of the pull tab by extending the embossments into the cutouts from inner faces of the latch springs, whereby the latch releasing portion engage with the inner faces of the latch spring, respectively.

15. An electrical connector assembly comprising:

a casing including a metallic base member and a metallic cover member commonly defining a receiving space;

a printed circuit board positioned in the receiving space;

an insulative housing enclosing in the casing and having a mating section at a front portion thereof;

a plurality of contacts disposed in the housing and electrically connected to the printed circuit board;

an IC mounted upon the printed circuit board; wherein at least one of said base member and said cover includes an engaging device directly contacting the IC for thermal conduction.

16. The connector assembly as claimed in claim 15, wherein said engaging device is integrally formed with said one of the base member and the cover member.

17. The connector assembly as claimed in claim 15, wherein said engaging device is essentially of a heat sink function with mass material for efficiently absorbing heat from the IC.

18. The connector assembly as claimed in claim 17, wherein said one of the base member and said cover member defines a plurality of grooves adjacent to said engaging device and exposed to an exterior for heat dissipation to air.

19. The connector assembly as claimed in claim 18, wherein a cable is connected to the printed circuit board and extends out of the casing.

20. The connector assembly as claimed in claim 15, wherein the engaging device is compliant with the IC in either shape or dimension.

* * * * *